US009226349B2

(12) United States Patent
Kikuchi et al.

(10) Patent No.: US 9,226,349 B2
(45) Date of Patent: Dec. 29, 2015

(54) SEMICONDUCTOR LIGHT SOURCE LIGHTING CIRCUIT

(71) Applicants: Satoshi Kikuchi, Shizuoka (JP); Takanori Namba, Shizuoka (JP); Masayasu Ito, Shizuoka (JP)

(72) Inventors: Satoshi Kikuchi, Shizuoka (JP); Takanori Namba, Shizuoka (JP); Masayasu Ito, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 338 days.

(21) Appl. No.: 13/856,492

(22) Filed: Apr. 4, 2013

(65) Prior Publication Data

US 2013/0278165 A1 Oct. 24, 2013

(30) Foreign Application Priority Data

Apr. 20, 2012 (JP) ..... 2012-096410

(51) Int. Cl.
*H05B 37/02* (2006.01)
*H05B 33/08* (2006.01)

(52) U.S. Cl.
CPC ..... *H05B 33/0815* (2013.01); *H05B 33/0848* (2013.01)

(58) Field of Classification Search
None
See application file for complete search history.

(56) References Cited

U.S. PATENT DOCUMENTS

| | | | | |
|---|---|---|---|---|
| 7,906,943 | B2 * | 3/2011 | Isobe et al. | 323/223 |
| 8,928,244 | B2 * | 1/2015 | Kikuchi et al. | 315/291 |
| 8,947,017 | B2 * | 2/2015 | Kikuchi et al. | 315/307 |
| 2010/0033420 | A1 | 2/2010 | Jheng | |
| 2010/0181914 | A1 | 7/2010 | Kasaba et al. | |
| 2012/0074860 | A1 | 3/2012 | Lee | |

FOREIGN PATENT DOCUMENTS

| | | | |
|---|---|---|---|
| JP | 2010-170704 | A | 8/2010 |
| TW | 201008396 | A | 2/2010 |
| WO | 2008/017467 | A1 | 2/2008 |

OTHER PUBLICATIONS

Espacenet abstract JP2010170704A dated Aug. 5, 2010 (1 page).
Office Action issued in corresponding Chinese Application No. 201310140358.X, mailed on Oct. 11, 2014 (11 pages).
Extended European Search Report Issued in European Application No. 13162690.5; Dated: Sep. 5, 2013 (4 Pages).

* cited by examiner

*Primary Examiner* — Long Nguyen
(74) *Attorney, Agent, or Firm* — Osha Liang LLP

(57) ABSTRACT

A semiconductor light source lighting circuit is provided with: a switching regulator that generates a drive current of a semiconductor light source using a switching element; and a control circuit that controls ON/OFF of the switching element. The control circuit is provided with: a comparator that compares the drive current and a target value; a counter that counts a digital value in a count direction determined by a comparison result of the comparator; a digital-analog converter that converts the digital value into an analog signal; and a drive circuit that controls the ON/OFF of the switching element based on the analog signal. The counter counts the digital value at a speed determined by an ON/OFF cycle of the switching element.

3 Claims, 6 Drawing Sheets

SEMICONDUCTOR LIGHT SOURCE LIGHTING CIRCUIT

This application claims foreign priority from Japanese Patent Application No. 2012-096410 filed on Apr. 20, 2012, the entire contents of which are hereby incorporated by reference.

BACKGROUND OF THE INVENTION

1. Field of the Invention

The invention relates to a semiconductor light source lighting circuit for lighting a semiconductor light source such as an LED (Light Emitting Diode).

2. Related Art

In recent years, an LED having a longer life and lower power consumption has been used as a vehicular lamp such as a headlamp, instead of a conventional halogen lamp having a filament. Since a degree of light emission (e.g. a brightness) of the LED depends on a current flowing through the LED, it is necessary to provide a lighting circuit for adjusting the current flowing through the LED in order to use the LED as a light source.

Such a lighting circuit usually includes a switching regulator for generating the current flowing through the LED using a switching element and a control circuit for controlling the switching regulator. The control circuit includes an error amplifier and performs a feedback control such that the current flowing through the LED is to be stable (see, for example, JP-A-2010-170704).

In order to reduce a circuit size by improving a performance of the feedback control, a digitization of the control circuit may be conceivable. However, as a result of the digitization, there may be a possibility that an oscillation occurs in the current flowing through the LED by an interaction between a counting operation in the feedback control and a switching operation of the switching regulator.

SUMMARY OF THE INVENTION

One or more embodiments provide a semiconductor light source lighting circuit which is capable of suppressing an oscillation of a drive current even when the circuit is digitized.

DETAILED DESCRIPTION OF THE EMBODIMENTS

Figure 1:
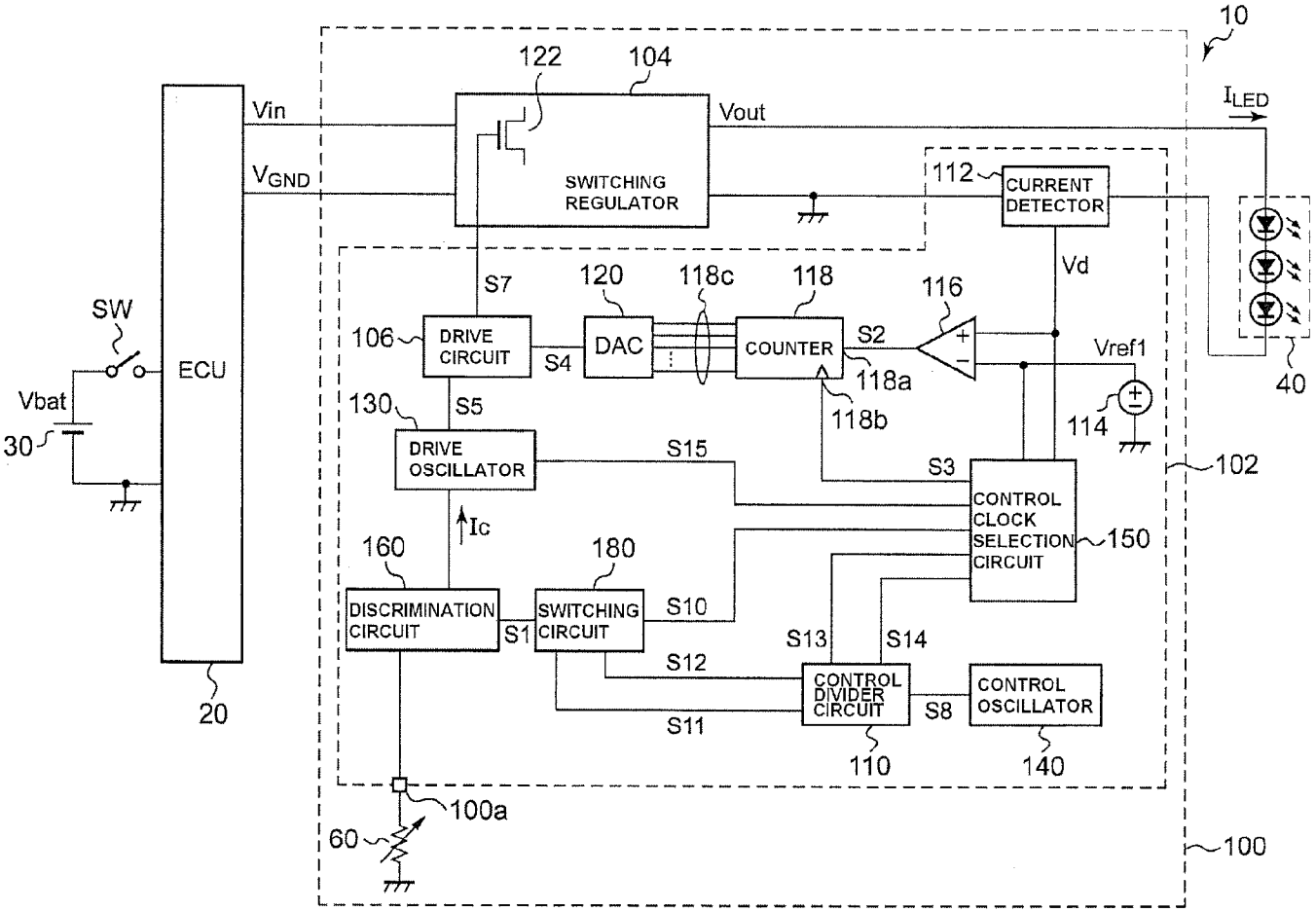
FIG. 1 is a circuit diagram showing a configuration of an onboard circuit including a semiconductor light source lighting circuit according to an exemplary embodiment.

The same or similar components, members and signals shown in each drawing are denoted by the same reference numerals and a duplicated description thereof is appropriately omitted. In each drawing, some of the members that are not important for descriptive purposes are omitted. In addition, the reference numerals used to denote voltage, current or resistance or the like are sometimes used to represent respective values of voltage, current or resistance as necessary.

In this specification, a "state in which a member A is connected to a member B" includes not only the case where the member A and the member B are physically directly connected to each other but also the case where the member A and the member B are indirectly connected to each other via another member which does not affect the electric connection state therebetween. Likewise, a "state in which a member C is provided between a member A and a member B" includes not only the case where the member A and the member C or the member B and the member C are directly connected to each other but also the case where the member A and the member C or the member B and the member C are indirectly connected via another member which does not affect the electric connection state therebetween.

According to embodiments, a semiconductor light source light circuit may include a switching regulator which generates a drive current flowing through an LED using a switching element and a control circuit which performs a current feedback control for the ON/OFF of the switching element such that the magnitude of the drive current approximates to a target value. In the current feedback control, a control value such as an amount of error may be digitally held and updated. A counting cycle of such a digital control value may be determined by the ON/OFF cycle of the switching element of the switching regulator. By doing so, it would be possible to avoid a situation where the ON/OFF cycle of the switching element and the counting cycle of the digital control value are too close and therefore it would be possible to suppress an oscillation of the drive current.

FIG. 1 is a circuit diagram showing a configuration of an onboard circuit 10 mounted on a vehicle. The onboard circuit 10 includes a semiconductor light source lighting circuit 100 according to an exemplary embodiment, an engine control unit (ECU) 20, a battery 30, and an LED 40. The LED 40 may be configured by connecting three LED elements in series. The LED 40 may be configured in such a way that each LED element can be individually turned ON/OFF by a bypass switch (not shown) or the like.

The engine control unit 20 is a micro controller for performing a comprehensive electric control of the vehicle. The engine control unit 20 is connected to the battery 30 via a switch SW. As the switch SW is turned on, the engine control unit 30 receives a battery voltage $V_{bat}$ from the battery 30. The engine control unit 20 supplies the DC battery voltage $V_{bat}$ as the input voltage $V_{in}$ to the semiconductor light source lighting circuit 100. The engine control unit 20 also supplies a fixed voltage, that is, a ground potential $V_{GND}$ (=0 V) to the semiconductor light source lighting circuit 100.

When a sudden load is applied to the battery 30, such as during start up of an engine, the battery voltage $V_{bat}$ is decreased. And, when the load is eliminated, the battery voltage $V_{bat}$ is increased. Correspondingly, the input voltage $V_{in}$ is variable.

The semiconductor light source lighting circuit 100 includes a switching regulator 104, a control circuit 102 to control the switching regulator 104 and an external variable resistor 60.

The switching regulator 104 converts an input voltage $V_{in}$ inputted from the engine control unit 20 into an output voltage $V_{out}$ suitable for a forward voltage $V_f$ of the LED 40 using a switching element 122 and applies the output voltage to an anode of the LED 40. The switching element 122 may be a transistor such as MOSFET (Metal Oxide Semiconductor Field Effect Transistor). From the viewpoint of the current, the switching regulator 104 generates a drive current flowing through the LED 40 from the input voltage $V_{in}$ using the switching element 122. The ground potential of the switching regulator 104 is supplied from the engine control unit 20.

The control circuit 102 controls the ON/OFF of the switching element 122 so that the magnitude of a drive current $I_{LED}$ approximates to a target value. The control circuit 102 includes a current detection part 112, a first reference voltage source 114, an error comparator 116, an up/down counter 118, a D/A converter 120, a drive circuit 106, a control clock selection circuit 150, a control divider circuit 110, a drive oscillator 130, a control oscillator 140, a discrimination circuit 160 and a switching circuit 180. The control circuit 102 may be realized by a micro computer.

The current detection part 112 detects the magnitude of the drive current ILED. The current detection part 112 is a current detection resistor through which the drive current $I_{LED}$ flows, for example. The current detection part 112 generates a detection voltage $V_d$ according to the magnitude of the drive current $I_{LED}$ and applies the detection voltage $V_d$ to a non-inverting input terminal of the error comparator 116. The current detection part 112 supplies the detection voltage $V_d$ to the control clock selection circuit 150. The detection voltage $V_d$ is generated on the basis of the fixed voltage such as the ground potential.

The first reference voltage source 114 generates a first reference voltage $V_{ref1}$ corresponding to a target value of the magnitude of the drive current $I_{LED}$ and applies the first reference voltage $V_{ref1}$ to an inverting input terminal of the error comparator 116. The first reference voltage source 114 supplies the first reference voltage $V_{ref1}$ to the control clock selection circuit 150. The first reference voltage $V_{ref1}$ is generated on the basis of the fixed voltage.

The error comparator 116 compares the detection voltage $V_d$ and the first reference voltage $V_{ref1}$. Specifically, the error comparator 116 compares the magnitude of the drive current $I_{LED}$ represented by the detection voltage $V_d$ and the target value represented by the first reference voltage $V_{ref1}$. The error comparator 116 generates an error signal S2 that is asserted or negated in accordance with the magnitude relation between the detection voltage $V_d$ and the first reference voltage $V_{ref1}$ and outputs the error signal to the up/down counter 118. In particular, the error signal S2 is asserted when $V_d \geq V_{ref1}$ and the voltage of the error signal S2 becomes high level. And, the error signal S2 is negated when $V_d < V_{ref1}$ and the voltage of the error signal S2 becomes low level.

The up/down counter 118 counts a control digital value in a count direction determined by the comparison result of the error comparator 116. An element having the same function as 74-series '191 which is a standard logic IC, for example, may be employed as the up/down counter 118. The up/down counter 118 includes an U/D control terminal 118*a* to which the error signal S2 is inputted, a clock pulse input terminal 118*b* to which a control clock signal S3 is inputted and output terminals 118*c*, the number of which corresponds to the number of bits of the control digital value to be counted.

In a case where the voltage of the error signal S2 becomes high level, the up/down counter 118 counts up the control digital value in accordance with the transition of the control clock signal S3, that is, each time when a rising edge appears in the control clock signal S3. In a case where the voltage of the error signal S2 becomes low level, the up/down counter 118 counts down the control digital value each time when a rising edge appears in the control clock signal S3. The up/down counter 118 outputs a present control digital value from the output terminal 118*c* to the D/A converter 120.

The D/A converter 120 converts the control digital value outputted from the output terminal 118*c* to a duty ratio setting signal S4 which has a analog voltage according to the control digital value. The digital-analog conversion processing itself in the D/A converter 120 may be performed using a conventional digital-analog conversion technique. The D/A converter 120 outputs the duty ratio setting signal S4 to the drive circuit 106. The duty ratio setting signal S4 has higher voltage as the control digital value becomes greater.

The drive circuit 106 controls the ON/OFF duty ratio of the switching element 122 based on the duty ratio setting signal S4 obtained as a result of the conversion by the D/A converter 120. The drive circuit 106 compares the duty ratio setting signal S4 and a sawtooth wave signal S5 whose voltage is changed to a sawtooth wave form at the drive frequency f2. The drive circuit 106 generates an element control signal S7 whose voltage is changed to a rectangular wave form at the drive frequency f2, based on the result of comparison. The element control signal S7 has a duty ratio according to the voltage of the duty ratio setting signal S4. High duty of the element control signal S7 becomes smaller as the voltage of the duty ratio setting signal S4 becomes higher. The drive circuit 106 outputs the generated element control signal S7 to a control terminal (that is, a gate) of the switching element 122. Consequently, as the control digital value becomes greater, the on-duty of the switching element 122 becomes smaller and acts in a direction to decrease the drive current MED. In this way, a current feedback control to approximate the drive current $I_{LED}$ to the target value is performed in the control circuit 102.

The ON/OFF frequency of the switching element 122 is the drive frequency f2 and the ON/OFF cycle thereof is 1/f2.

The drive oscillator 130 generates a sawtooth wave signal S5 having the drive frequency f2 according to the magnitude of a drive frequency setting current $I_c$ and outputs the sawtooth wave signal to the drive circuit 106. The drive oscillator 130 generates a drive clock signal S15 of rectangular wave having the drive frequency f2 and outputs the drive clock signal to the control clock selection circuit 150. A technique to generate the sawtooth wave or the rectangular wave having the frequency according to the current value is well-known itself by a relaxation oscillator or the like, for example.

The control oscillator 140 is an oscillator which is provided independent of the drive oscillator 130. The control oscillator generates a clock source signal S8 and supplies the clock source signal to the control divider circuit 110. The voltage of the clock source signal S8 is changed to the rectangular wave form in a timing frequency f3 of about 2 MHz.

The control divider circuit 110 generates a first division signal S11, a second division signal S12, a third division signal S13 and a fourth division signal S14 which are obtained by respectively dividing the clock source signal S8 at predetermined division ratios of N1, N2, N3 and N4 (N1>N2, N3>N4). The control divider circuit 110 output the first division signal S11 and the second division signal S12 to the switching circuit 180 and outputs the third division signal S13 and the fourth division signal S14 to the control clock selection circuit 150. The control divider circuit 110 may be configured by one or more counters, or the like. As an example, N1=512, N2=32, N3=4 and N4=1. Specifically, the frequency of the first division signal S11 is about 3.9 kHz, the frequency of the second division signal S12 is about 62.5 kHz, the frequency of the third division signal S13 is about 500 kHz and the frequency of the fourth division signal S14 is about 2 MHz.

The discrimination circuit 160 discriminates the magnitude relation between the drive frequency f2 and a frequency threshold $f_{th}$. The discrimination circuit 160 generates a drive frequency setting current $I_c$ according to the resistance value of the external variable resistor 60 connected to an external resistor terminal 100*a* of the control circuit 102, supplies the drive frequency setting current $I_c$ to the drive oscillator 130 and compares the drive frequency f2 determined by the resistance value with the frequency threshold $f_{th}$. In the exemplary embodiment, a resistance value which causes the drive frequency f2 to be 300 kHz (±100 kHz) and a resistance value which causes the drive frequency f2 to be 2 MHz are considered as the resistance value of the external variable resistor 60. The frequency threshold $f_{th}$ is set to about 1 MHz.

Generally, the circuit element becomes smaller as the drive frequency f2 becomes higher. However, in this case, a noise performance is degraded and an amount of heat to be generated is increased. Accordingly, an optimum drive frequency f2 is different for each application. For this reason, the semiconductor light source lighting circuit 100 is so configured that the drive frequency f2 can be changed by the resistance value of the external variable resistor 60. Thereby, a user can set the drive frequency f2 to an optimal value according to the applications without changing the interior of the control circuit 102.

The discrimination circuit 160 generates a discrimination signal S1 and outputs the discrimination signal to the switching circuit 180. The discrimination signal S1 becomes high level when the drive frequency f2 is greater than the frequency threshold $f_{th}$ and becomes low level when the drive frequency f2 is less than the frequency threshold $f_{th}$.

The switching circuit 180 switches the counting speed of the up/down counter 118 when the magnitude of the drive current $I_{LED}$ is relatively close to the target value, based on the discrimination signal S1. The switching circuit 180 outputs the second division signal S12 as the steady clock signal S10 to the control clock selection circuit 150 when the drive frequency f2 is greater than the frequency threshold $f_{th}$. The switching circuit 180 outputs the first division signal S11 as the steady clock signal S10 to the control clock selection circuit 150 when the drive frequency f2 is less than the frequency threshold $f_{th}$.

Figure 2:
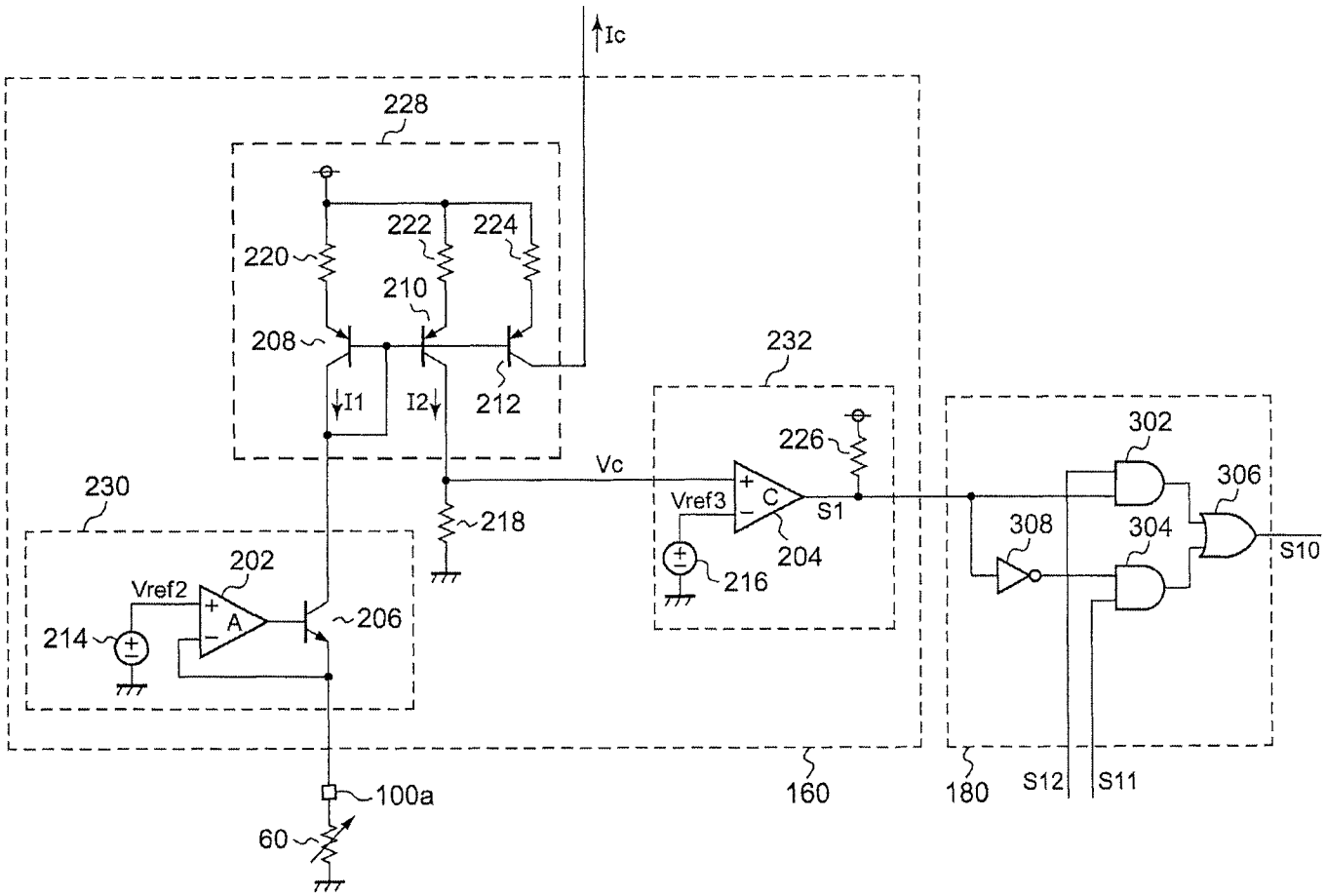
FIG. 2 is a circuit diagram showing a configuration of a discrimination circuit and a switching circuit which are shown in FIG. 1.

FIG. 2 is a circuit diagram showing a configuration of the discrimination circuit 160 and the switching circuit 180. The discrimination circuit 160 includes a current mirror circuit 228, a voltage regulator circuit 230, a fifth resistor 218 and a comparison circuit 232.

The current mirror circuit 228 includes a first pnp-type bipolar transistor 208, a second pnp-type bipolar transistor 210, a third pnp-type bipolar transistor 212, a sixth resistor 220, a seventh resistor 222 and an eighth resistor 224. These circuit elements are connected to each other so as to configure a conventional current mirror circuit. The current mirror circuit 228 uses a setting current $I_1$ as an input and uses an output current $I_2$ and the drive frequency setting current $I_c$ as an output. The current mirror circuit 228 causes the magnitude of the output current $I_2$ and the drive frequency setting current $I_c$ to be substantially same as the magnitude of the setting current $I_1$. The current mirror circuit 228 supplies the drive frequency setting current $I_c$ to the drive oscillator 130. As the output current $I_2$ flows through the fifth resistor 218, the output current is converted into a drive frequency setting voltage $V_c$. Since the drive frequency f2 is determined by the magnitude of the drive frequency setting current $I_c$, the drive frequency setting voltage $V_c$ corresponds to the drive frequency f2.

The voltage regulator circuit 230 is operated so that the voltage applied to the external resistor terminal 100*a* approximates to a second reference voltage $V_{ref2}$ generated by a second reference voltage source 214. The voltage regulator circuit 230 includes an operational amplifier 202, a first npn-type bipolar transistor 206 and a second reference voltage source 214. The second reference voltage $V_{ref2}$ is applied to a non-inverting input terminal of the operational amplifier 202 and an inverting input terminal of the operational amplifier 202 is connected to the external resistor terminal 100*a*. The setting current $I_1$ is inputted to a collector of the first npn-type bipolar transistor 206 and a base of the first npn-type bipolar transistor is connected to an output terminal of the operational amplifier 202. An emitter of the first npn-type bipolar transistor 206 is connected to the external resistor terminal 100*a*.

By the action of the voltage regulator circuit 230, the voltage of the external resistor terminal 100*a* is maintained substantially constant in the vicinity of the second reference voltage $V_{ref2}$ even when the resistance value of the external variable resistor 60 is varied. When the resistance value of the external variable resistor 60 is represented as "$R_V$", a formula of $I_1=V_{ref2}/R_V$ is established. Specifically, it is possible to change the magnitude of the setting current $I_1$, that is, the drive frequency f2 by changing the resistance value of the external variable resistor 60.

The comparison circuit 232 compares the drive frequency f2 and the frequency threshold $f_{th}$. The comparison circuit 232 includes a fifth comparator 204, a third reference voltage source 216 and a ninth resistor 226. The third reference voltage source 216 generates a third reference voltage $V_{ref3}$ corresponding to the frequency threshold $f_{th}$ and applies the third reference voltage to an inverting input terminal of the fifth comparator 204. A drive frequency setting voltage $V_c$ is applied to a non-inverting input terminal of the fifth comparator 204. The ninth resistor 226 is provided between a power supply voltage terminal and an output terminal of the fifth comparator 204 and serves as a pull-up resistor for the fifth comparator 204.

The fifth comparator 204 compares the drive frequency setting voltage $V_c$ and the third reference voltage $V_{ref3}$. Specifically, the fifth comparator 204 compares the drive frequency f2 represented by the drive frequency setting voltage $V_c$ and the frequency threshold $f_{th}$ represented by the third reference voltage $V_{ref3}$. The fifth comparator 204 generates the above-described discrimination signal S1 representing the comparison result.

The switching circuit 180 includes a first AND gate 302, an eighth AND gate 304, a third OR gate 306 and a fifth inverter 308. The fifth inverter 308 inverts the level of the discrimination signal S1. The first AND gate 302 outputs a logical product of the second division signal S12 and the discrimination signal S1. The eighth AND gate 304 outputs a logical product of the output signal of the fifth inverter 308 and the first division signal S11. The third OR gate 306 outputs a logical sum of the output signal of the first AND gate 302 and the output signal of the eighth AND gate 304 as the steady clock signal S10 to the control clock selection circuit 150.

By returning to FIG. 1, the control clock selection circuit 150 implements the following two functions.

<Function 1>

Function 1 is to generate the control clock signal S3 of rectangular wave having the frequency according to the magnitude relation between the drive frequency f2 and the frequency threshold $f_{th}$ in a case where the magnitude of the drive current $I_{LED}$ is relatively close to the target value. When this function is implemented, the up/down counter 118 counts the control digital value at a speed which is determined by the drive frequency f2. Particularly, the up/down counter 118 counts the digital value faster as the drive frequency f2 becomes higher.

<Function 2>

Function 2 is to cause the frequency of the control clock signal S3 to be a frequency which is substantially independent of the drive frequency f2 and higher than the frequency thereof when the magnitude of the drive current $I_{LED}$ is relatively close to the target value, in a case where the magnitude of the drive current $I_{LED}$ is relatively far from the target value. When this function is implemented, the up/down counter 118 performs a counting operation based on the clock source signal S8 which is outputted from the control oscillator 140 different from the drive oscillator 130. Further, the up/down counter 118 counts the control digital value faster than a case where the magnitude of the drive current $I_{LED}$ is relatively close to the target value.

The control clock selection circuit 150 compares the detection voltage $V_d$ and the first reference voltage $V_{ref1}$ to determine whether the difference or ratio between the magnitude of the drive current $I_{LED}$ and the target value is within a predetermined error range or not. The error range contains a value of 0 in a case of the difference and a value of 1 in a case of the ratio. When it is determined that the difference or ratio is within the predetermined error range, the control clock selection circuit 150 selects the steady clock signal S10 among the steady clock signal S10, the third division signal S13 and the fourth division signal S14 and outputs the selected steady clock signal S10 as the control clock signal S3. When it is determined that the difference or ratio is not within the predetermined error range, the control clock selection circuit 150 selects the third division signal S13 or the fourth division signal S14 among the steady clock signal S10, the third division signal S13 and the fourth division signal S14, depending on the value of the difference or ratio. In particular, the control clock selection circuit 150 selects a signal of higher frequency as the difference or ratio between the magnitude of the drive current $I_{LED}$ and the target value becomes greater.

Table 1 shows a selection operation of the control clock selection circuit 150.

TABLE 1

| Target Value | $I_{LED}$ | Frequency of S3 (when f2 is 2 MHz) | Frequency of S3 (when f2 is 300 kHz) |
|---|---|---|---|
| 0.85 A | not less than 1.21 A | 2 MHz (500 ns) | 2 MHz (500 ns) |
| | 0.97 A to 1.21 A | 500 kHz (2 μs) | 500 kHz (2 μs) |
| | 0.73 A to 0.97 A | 62.5 kHz (16 μs) | 3.91 kHz (256 μs) |
| | 0.49 A to 0.73 A | 500 kHz (2 μs) | 500 kHz (2 μs) |
| | not more than 0.49 A | 2 MHz (500 ns) | 2 MHz (500 ns) |

In Table 1, the drive current $I_{LED}$ range of "0.73 A to 0.97 A" corresponds to the error range of "−0.12 A to 0.12 A" for the difference between the magnitude of the drive current $I_{LED}$ and the target value "0.85 A". The drive current $I_{LED}$ range of "0.97 A to 1.21 A" corresponds to a first deviation range of "0.12 A to 0.36 A" for the difference between the magnitude of the drive current $I_{LED}$ and the target value "0.85 A". The drive current $I_{LED}$ range of "not less than 1.21 A" corresponds to a second deviation range of "not less than 0.36 A" for the difference between the magnitude of the drive current $I_{LED}$ and the target value "0.85 A". The drive current $I_{LED}$ range of "0.49 A to 0.73 A" corresponds to a third deviation range of "−0.36 A to −0.12 A" for the difference between the magnitude of the drive current $I_{LED}$ and the target value "0.85 A". The drive current $I_{LED}$ range of "not more than 0.49 A" corresponds to a fourth deviation range of "not more than −0.36 A" for the difference between the magnitude of the drive current $I_{LED}$ and the target value "0.85 A".

Figure 3:
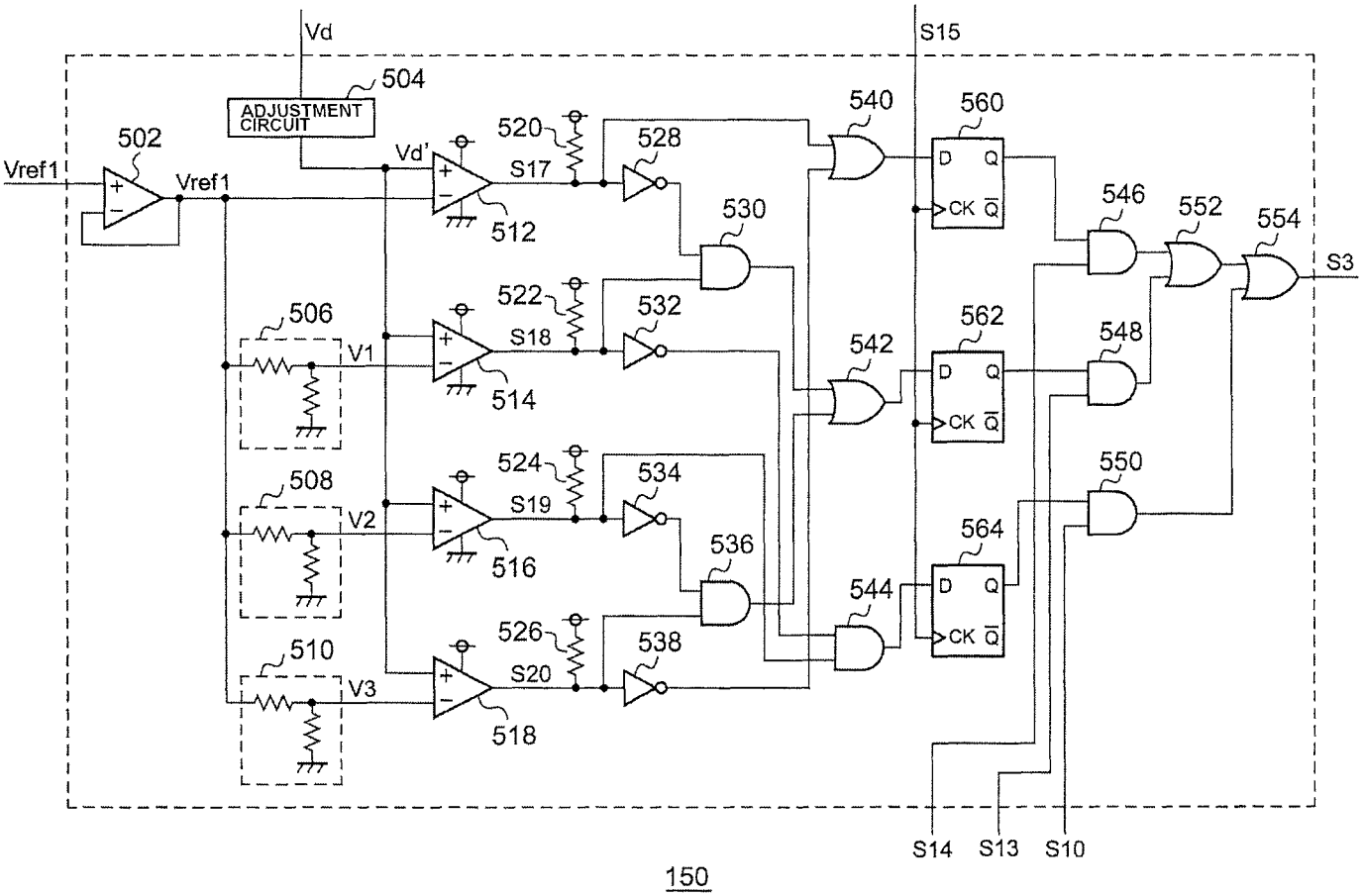
FIG. 3 is a circuit diagram showing a configuration of a control clock selection circuit shown in FIG. 1.

FIG. 3 is a circuit diagram showing a configuration of the control clock selection circuit 150. The control clock selection circuit 150 mainly includes a group of voltage-dividing circuits, a group of comparators, a group of logic gates and a group of D-type flip-flops. A buffer 502 receives the first reference voltage $V_{ref1}$ inputted to the control clock selection circuit 150 and buffers the first reference voltage. A first voltage-dividing circuit 506, a second voltage-dividing circuit 508 and a third voltage-dividing circuit 510 respectively divide the first reference voltage $V_{ref1}$ outputted by the buffer 502 and generates a first divided voltage $V_1$, a second divided voltage $V_2$ and a third divided voltage $V_3$. In this case, the resistance value of the divider circuit is particularly set so that a relation of $V_{ref1}>V_1>V_2>V_3$ is established.

An adjustment circuit 504 receives and adjusts the detection voltage Vd inputted to the control clock selection circuit 150 and generates a processed detection voltage $V_{d'}$. Each circuit constant of the first voltage-dividing circuit 506, the second voltage-dividing circuit 508, the third voltage-dividing circuit 510 and the adjustment circuit 504 is set so that $V_1>V_{d'}\geq V_2$ corresponds to the error range, $V_{ref1}>V_{d'}\geq>V_1$ corresponds to the first deviation range, $V_{d'}\geq V_{ref1}$ corresponds to the second deviation range, $V_2>V_{d'}\geq V_3$ corresponds to the third deviation range and $V_3>V_{d'}$ corresponds to the fourth deviation range.

A first comparator 512 compares the processed detection voltage $V_{d'}$ and the first reference voltage $V_{ref1}$ and generates a first comparison signal S17 which becomes high level when the processed detection voltage $V_{d'}\geq$the first reference voltage $V_{ref1}$ and becomes low level in other cases. A second comparator 514 compares the processed detection voltage $V_{d'}$ and the first divided voltage $V_1$ and generates a second comparison signal S18 which becomes high level when the processed detection voltage $V_{d'}\geq$the first divided voltage $V_1$ and becomes low level in other cases. A third comparator 516 compares the processed detection voltage $V_{d'}$ and the second divided voltage $V_2$ and generates a third comparison signal S19 which becomes high level when the processed detection voltage $V_{d'}\geq$the second divided voltage $V_2$ and becomes low level in other cases. A fourth comparator 518 compares the processed detection voltage $V_{d'}$ and third divided voltage $V_3$ and generates a fourth comparison signal S20 which becomes high level when the processed detection voltage $V_{d'}\geq$the third divided voltage $V_3$ and becomes low level in other cases. A first resistor 520, a second resistor 522, a third resistor 524 and a fourth resistor 526 are respectively pull-up resistors for the first comparator 512, the second comparator 514, the third comparator 516 and the fourth comparator 518.

A first inverter 528, a second inverter 532, a third inverter 534 and a fourth inverter 538 respectively invert the levels of the first comparison signal S17, the second comparison signal S18, the third comparison signal S19 and the fourth comparison signal S20.

A second AND gate 530 outputs a logical product of the output signal of the first inverter 528 and the second comparison signal S18. A third AND gate 536 outputs a logical product of the output signal of the third inverter 534 and the fourth comparison signal S20. A first OR gate 540 outputs a logical sum of the first comparison signal S17 and the output signal of the fourth inverter 538. A second OR gate 542 outputs a logical sum of the output signal of the second AND gate 530 and the output signal of the third AND gate 536. A seventh AND gate 544 outputs a logical product of the output signal of the second inverter 532 and the third comparison signal S19.

The output signal of the first OR gate 540, the output signal of the second OR gate 542 and the output signal of the seventh AND gate 544 are respectively inputted to a data terminal of a first D-type flip-flop 560, a data terminal of a second D-type flip-flop 562 and a data terminal of a third D-type flip-flop 564. The drive clock signal S15 is commonly inputted to a clock terminal of the first D-type flip-flop 560, a clock terminal of the second D-type flip-flop 562 and a clock terminal of the third D-type flip-flop 564. By these three D-type flip-flops, the frequency switching of the control clock signal S3 and the ON/OFF of the switching element 122 are synchronized.

A fourth AND gate 546 outputs a logical product of the fourth division signal S14 and a signal outputted from a non-inverting output terminal of the first D-type flip-flop 560. A fifth AND gate 548 outputs a logical product of the third division signal S13 and a signal outputted from a non-inverting output terminal of the second D-type flip-flop 562. A sixth AND gate 550 outputs a logical product of the steady clock signal S10 and a signal outputted from a non-inverting output terminal of the third D-type flip-flop 564.

A fourth OR gate 552 outputs a logical sum of the output signal of the fourth AND gate 546 and the output signal of the fifth AND gate 548. A fifth OR gate 554 outputs a logical sum of the output signal of the fourth OR gate 552 and the output signal of the sixth AND gate 550.

The control clock selection circuit 150 outputs the output signal of the fifth OR gate 554 as the control clock signal S3.

For example, when $V_1>V_d>V_2$, the first comparison signal S17 and the second comparison signal S18 become low level and the third comparison signal S19 and the fourth comparison signal become high level. Since the first comparison signal S17 is low level and the output signal of the fourth inverter 538 is low level, the output signal of the first OR gate 540 becomes low level. Accordingly, the output signal of the fourth AND gate 546 becomes low level, regardless of the fourth division signal S14. In addition, since the output signal of the second OR gate 542 is also low level, the output signal of the fifth AND gate 548 becomes low level, regardless of the third division signal S13. On the other hand, since the output signal of the seventh AND gate 544 becomes high level, the output signal of the sixth AND gate 550 becomes the steady clock signal S10. As a result, the steady clock signal S10 is outputted as the control clock signal S3.

When the drive frequency f2 is greater than the frequency threshold $f_{th}$, the steady clock signal S10 becomes the second division signal S12 and the frequency thereof becomes about 62.5 kHz. On the other hand, when the drive frequency f2 is less than the frequency threshold $f_{th}$, the steady clock signal S10 becomes the first division signal S11 and the frequency thereof becomes about 3.91 kHz.

In this way, the selection operation shown in Table 1 is implemented by the control clock selection circuit 150 shown in FIG. 3.

An operation of the semiconductor light source lighting circuit 100 having the above configurations will be described.

Figure 4:
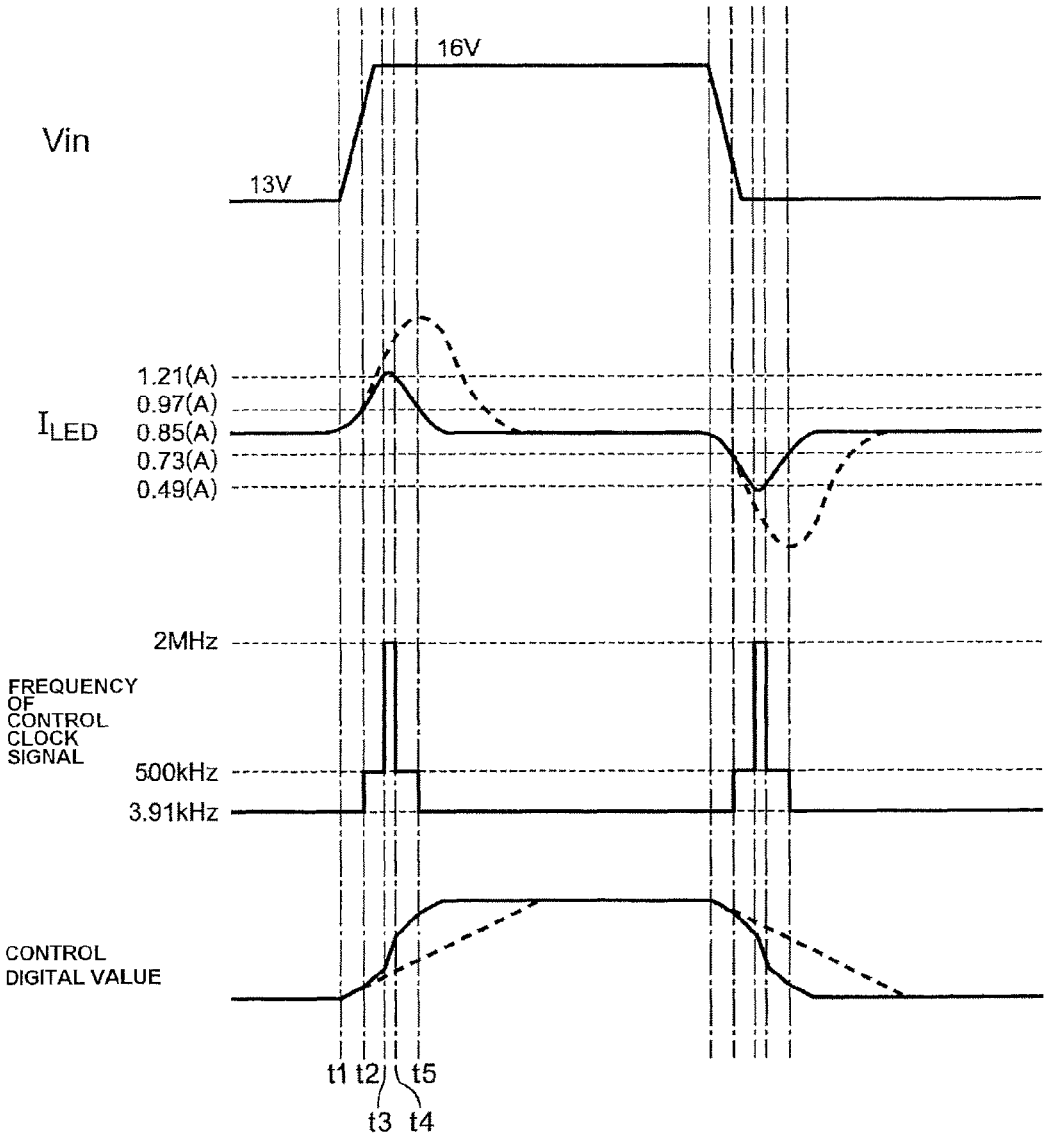
FIG. 4 is a time chart schematically showing an operation state of the semiconductor light source lighting circuit of FIG. 1 when an input voltage is suddenly varied.

FIG. 4 is a time chart schematically showing an operation state of the semiconductor light source lighting circuit 100 when the input voltage $V_{in}$ is suddenly varied. FIG. 4 represents the input voltage $V_{in}$, the drive current ILED, the frequency of the control clock signal S3 and the control digital value in the up/down counter 118, in order from the top.

At time t1, the input voltage $V_{in}$ begins to transition from 13 V to 16 V. In response to the rise of the input voltage $V_{in}$, the drive current $I_{LED}$ starts to rise from 0.85 A, which is the target value. Since the drive current $I_{LED}$ becomes higher than the target value, the up/down counter 118 counts up the control digital value. The control clock selection circuit 150 selects the steady clock signal S10 as the control clock signal S3 and the frequency of the control clock signal S3 is a value corresponding to the drive frequency f2. Here, the drive frequency f2 is set to 300 kHz. Accordingly, the frequency of the control clock signal S3 is about 3.91 kHz. The count-up speed is slower than the rising speed of the drive current $I_{LED}$ according to the rise of the input voltage $V_{in}$ and the drive current $I_{LED}$ continues to rise.

At time t2, the difference between the magnitude of the drive current $I_{LED}$ and the target value falls within the first deviation range. That is, the drive current $I_{LED}$ exceeds 0.97 A. The control clock selection circuit 150 selects the third division signal S13 as the control clock signal S3 and the frequency of the control clock signal S3 becomes about 500 kHz. Accordingly, the count-up of the up/down counter 118 becomes faster.

At time t3, the difference between the magnitude of the drive current $I_{LED}$ and the target value falls within the second deviation range. That is, the drive current $I_{LED}$ exceeds 1.21 A. The control clock selection circuit 150 selects the fourth division signal S14 as the control clock signal S3 and the frequency of the control clock signal S3 becomes about 2 MHz. Accordingly, the count-up of the up/down counter 118 becomes even faster.

At time t4, the drive current $I_{LED}$ is less than 1.21 A. The control clock selection circuit 150 selects the third division signal S13 as the control clock signal S3 and the frequency of the control clock signal S3 becomes about 500 kHz. Accordingly, the count-up of the up/down counter 118 becomes slower.

At time t5, the drive current $I_{LED}$ is less than 0.97 A. The control clock selection circuit 150 selects the steady clock signal S10 as the control clock signal S3 and the frequency of the control clock signal S3 becomes about 3.91 kHz. Accordingly, the count-up speed of the up/down counter 118 becomes equivalent to the speed prior to time t1.

The above description is similarly applied to even when the input voltage $V_{in}$ is changed from 16 V to 13 V, except that the direction of change is reversed.

According to the semiconductor light source lighting circuit 100 of the exemplary embodiment, the count-up speed of the up/down counter 118 is determined in accordance with the drive frequency f2. Accordingly, the frequency of count can be set so that the frequency of count is not too close to the drive frequency f2. Thereby, it is possible to suppress the oscillation of the drive current $I_{LED}$ by the interaction between a switching operation of the switching regulator 104 and an update of the control value in the current feed control.

When there is no action for the sudden change of the input voltage $V_{in}$, the change in the control digital value cannot keep up with the change in the input voltage $V_{in}$ and thus large overshoot or undershoot may be caused. The change in the control digital value and the change in the drive current $I_{LED}$ in this case are indicated by a broken line in FIG. 4. As the input voltage $V_{in}$ is changed from 13 V to 16 V, the control digital value is changed at a relatively slow rate from a value which causes the drive current $I_{LED}$ to be the target value at the input voltage $V_{in}$ of 13 V to a value which causes the drive current $I_{LED}$ to be the target value at the input voltage $V_{in}$ of 16 V. Specifically, when the switching regulator 104 is a boost type, the control digital value is slowly changed so as to reduce the on-duty of the switching element 22. Since the change in the control digital value is slower than the change in the input voltage $V_{in}$, the on-duty remains relatively large even when the input voltage $V_{in}$ reaches 16 V. Accordingly, a large amount of energy is supplied to the LED 40 and therefore the overshoot of the drive current $I_{LED}$ can be caused. When the input voltage $V_{in}$ is changed from 16 V to 13 V, a reverse state of the above description is obtained and the undershoot of the drive current $I_{LED}$ can be caused.

On the contrary, in the semiconductor light source lighting circuit 100 of the exemplary embodiment, the up/down counter 118 counts the control digital value faster as the difference between the magnitude of the drive current $I_{LED}$ and the target value becomes larger. Specifically, the up/down counter 118 is operated at a relatively low-frequency clock when the drive current $I_{LED}$ is close to the target value but is operated at a high-frequency clock as the detected value of the drive current $I_{LED}$ is far from the target value, so that the drive current $I_{LED}$ can be quickly converged to the target value. By doing so, the control digital value can be quickly changed while keeping up with the change in the input voltage $V_{in}$ even when the input voltage $V_{in}$ is suddenly changed. As a result, it is possible to suppress the overshoot or undershoot and therefore it is possible to prevent the deterioration of the LED 40.

From the viewpoint of reduction of the circuit size, it is desirable that the element control signal related to the switching element 122 and the control clock signal related to the up/down counter are generated by the same oscillator. However, in this case, the control frequency of the up/down counter is also decreased in conjunction with the drive frequency when the drive frequency f2 is decreased. Accordingly, when the drive frequency f2 is low and also the input voltage $V_{in}$ is suddenly changed, there is a possibility that it is difficult to respond to the sudden change of the input voltage and therefore the overshoot or undershoot of the drive current $I_{LED}$ can be caused, even if the up/down counter is quickly counted in response to an increase in the difference between the drive current $I_{LED}$ and the target value. For example, 2 MHz and 300 kHz are assumed as the drive frequency f2. In a case where the drive frequency f2 is set to 2 MHz, the control frequency f2 can be increased to about 2 MHz by quickly counting the up/down counter. However, in a case where the drive frequency f2 is set to 300 kHz, a counting speed of the up/down counter has a limit of about 300 kHz.

Accordingly, in the semiconductor light source lighting circuit 100 according to the exemplary embodiment, the drive oscillator 130 for driving the switching element 122 and the control oscillator 140 for the up/down counter 118 are separately provided. When the difference between the magnitude of the drive current $I_{LED}$ and the target value is relatively large, the semiconductor light source lighting circuit 100 generates the control clock signal S3 faster using the clock source signal S8 outputted by the control oscillator 140. At this time, the frequency of the control clock signal S3 does not depend on the drive frequency f2. Thereby, the up/down counter 118 can count the control digital value fast enough to respond to the sudden change of the input voltage $V_{in}$, even if the drive frequency f2 is low. As a result, it is possible to suppress occurrence of the overshoot or undershoot of the drive current ILED, thereby maintaining the light-emitting performance of the LED 40.

In the semiconductor light source lighting circuit 100, occurrence frequency of the sudden change of the input voltage $V_{in}$ is generally not very high. In most cases, the semiconductor light source lighting circuit 100 is operated in a situation where the difference between the magnitude of the drive current $I_{LED}$ and the target value is relatively small. When the frequency of the control clock signal S3 and the drive frequency f2 remain independent of each other during such a steady operation, there is a possibility that the oscillation of the drive current $I_{LED}$ occurs depending on the setting of the drive frequency f2. Therefore, the semiconductor light source lighting circuit 100 according to the exemplary embodiment determines the speed of the counting operation of the up/down counter 118 during the steady operation in accordance with the drive frequency f2. By doing so, it is possible to suppress the oscillation of the drive current $I_{LED}$ during the steady operation.

The external variable resistor 60 which has a resistance value giving a desired drive frequency f2 is connected to the external resistor terminal 100*a* by a user. Here, in the semiconductor light source lighting circuit 100 according to the exemplary embodiment, the switching of the frequency of the control clock signal S3 by the drive frequency f2 is automatically performed by the discrimination circuit 160 and the switching circuit 180. Accordingly, it is not necessary for a user to manually designate the frequency of the control clock signal S3 during the steady operation. As a result, it is not necessary to further provide a terminal for inputting a signal corresponding to such a designation in the control circuit 102 and therefore it is possible to reduce the number of terminals in the control circuit 102.

Figure 5A:
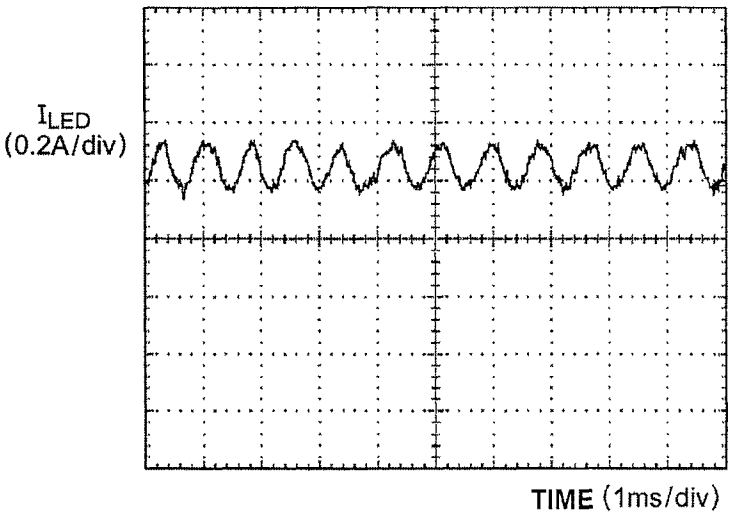
FIG. 5(*a*) and FIG. 5(*b*) are waveform diagrams showing a waveform of a drive current during a steady operation.
Figure 5B:
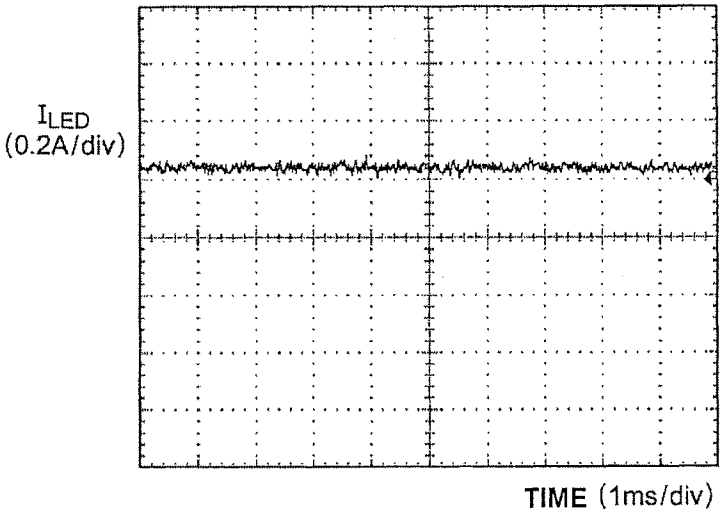

FIGS. 5(*a*) and (*b*) are waveform diagrams showing a waveform of the drive current $I_{LED}$ during the steady operation. In both FIGS. 5(*a*) and (*b*), the input voltage $V_{in}$ is set to 13.5 V and the drive frequency f2 is set to 200 kHz. FIG. 5(*a*) corresponds to a case where the frequency of the control clock signal S3 and the drive frequency f2 remain independent of each other. Particularly in FIG. 5(*a*), the frequency of the control clock signal S3 during the steady operation sets to about 62.5 kHz, regardless of the drive frequency f2. In this case, oscillation appears in the drive current ILED.

FIG. 5(*b*) corresponds to a case where the speed of the counting operation of the up/down counter 118 is determined in accordance with the drive frequency f2. Particularly in FIG. 5(*b*), the frequency of the control clock signal S3 during the steady operation is represented in Table 1. Here, since the drive frequency f2 is 200 kHz, the frequency of the control clock signal S3 is about 3.91 kHz. In this case, noticeable oscillation is not seen in the drive current $I_{LED}$.

Figure 6B:
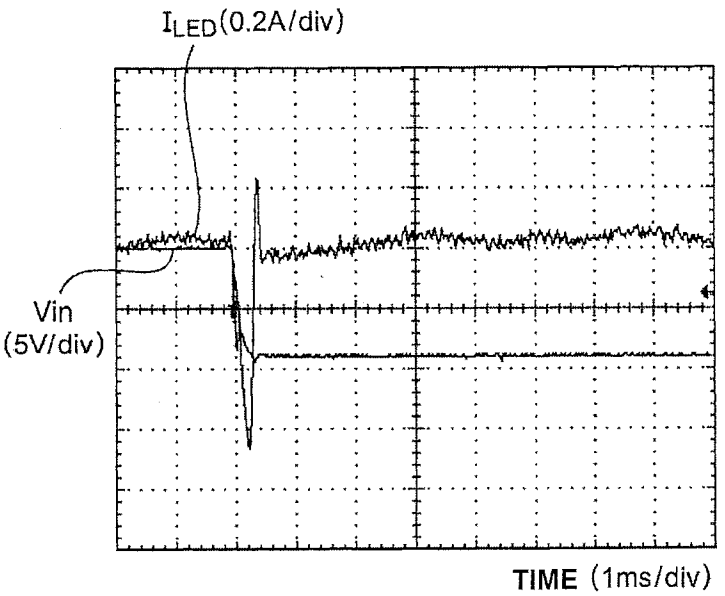
FIG. 6(*a*) and FIG. 6(*b*) are waveform diagrams showing a waveform of a drive current when an input voltage is suddenly varied.
Figure 6A:
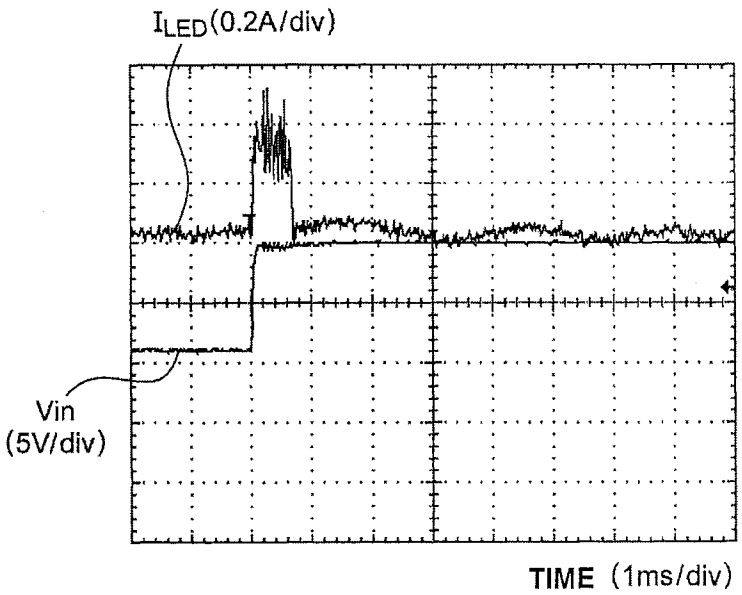

FIGS. 6(*a*) and (*b*) are waveform diagrams showing a waveform of the drive current $I_{LED}$ when the input voltage $V_{in}$ is suddenly varied. The frequency of the control clock signal S3 is shown in Table 1. The drive frequency f2 is set to 200 kHz. The reason is that there is a possibility that a light-emitting performance of the LED 40 at the time of the sudden change of the input voltage $V_{in}$ is deteriorated as the drive frequency f2 becomes lower. FIG. 6(*a*) shows the response of the drive current $I_{LED}$ when the input voltage $V_{in}$ is rapidly increased from 12 V to 20 V and FIG. 6(*b*) shows the response of the drive current $I_{LED}$ when the input voltage $V_{in}$ is rapidly decreased from 20 V to 12 V. In the exemplary embodiment, the control frequency of the up/down counter 118 during rapid counting is set to a high value regardless of the drive frequency f2. Accordingly, as shown in FIGS. 6(*a*) and (*b*), the response ability of the drive current $I_{LED}$ at the time of the sudden change of the input voltage $V_{in}$ is enhanced and the overshoot or undershoot of the drive current $I_{LED}$ is suppressed.

Hereinabove, the configuration and operation of the semiconductor light source lighting circuit according to the exemplary embodiment has been described. The exemplary embodiment is merely an example and it is to be understood by those skilled in the art that the combinations of each component or process can be variously modified and that such modifications fall within the scope of the invention.

Although the control circuit 102 including the drive oscillator 130 and the control oscillator 140 has been described in the foregoing embodiment, the invention is not limited to this configuration. For example, a single oscillator may be used to generate the clock signal of the up/down counter 118 and the element control signal for driving the switching element 122. In this case, since the frequency of the clock signal of the up/down counter 118 is varied in accordance with the frequency of the element control signal, it is possible to suppress the oscillation of the drive current.

Any combinations of the above-described components and optional modifications in the method, apparatus and system are also effective as aspects of the invention.

In accordance with embodiments, a semiconductor light source lighting circuit 100 may include: a switching regulator 104 that generates a drive current $I_{LED}$ of a semiconductor light source 40 using a switching element 122; and a control circuit 102 that controls ON/OFF of the switching element 122 so that the drive current $I_{LED}$ approximates to a target value. The control circuit 102 may include: a comparator 116 that compares the drive current $I_{LED}$ and the target value; an up/down counter 118 that counts a digital value in a count direction determined by a comparison result of the comparator 116; a digital-analog converter 120 that converts the digital value counted by the up/down counter 118 into an analog signal; and a drive circuit 106 that controls the ON/OFF of the switching element 112 based on the analog signal which is obtained as a result of the conversion by the digital-analog converter 120. The up/down counter 118 may count the digital value at a speed determined by an ON/OFF cycle of the switching element 122.

According to this structure, the counting speed of the up/down counter for counting the digital value depends on an ON/OFF cycle of the switching element.

According to this structure, it is possible to suppress an oscillation of the drive current even when the control circuit of the semiconductor light source lighting circuit is digitized.

According to embodiments, the drive circuit 106 may control the ON/OFF of the switching element 122 based on a signal outputted from a first oscillator 130. The up/down counter 118 may perform a counting operation based on a signal outputted from a second oscillator 140 different from the first oscillator 140 when the difference between the drive current $I_{LED}$ and the target value is greater than a current threshold. When the difference between the drive current $I_{LED}$ and the target value is greater than the current threshold, the up/down counter 118 may count the digital value faster than a case when the difference between the drive current $I_{LED}$ and the target value is smaller than the current threshold.

According to embodiments, the up/down counter 118 may count the digital value faster as the ON/OFF cycle of the switching element 122 is shorter.

According to embodiments, the semiconductor light source lighting circuit 100 may include a discrimination circuit 160 that discriminates a magnitude relation between the ON/OFF cycle of the switching element 122 and a cycle threshold, and a determination circuit 180 that determines a counting speed of the up/down counter 118 based on the discrimination result of the discrimination circuit 160.

In accordance with embodiments, a method of lighting a semiconductor light source 40 may include steps of: generating a drive current $I_{LED}$ of the semiconductor light source 40 using a switching element 122; comparing a drive current $I_{LED}$ and a target value by a comparator 116; counting a digital value in a count direction determined by a comparison result of the comparator 116; converting the digital value into an analog signal; and controlling ON/OFF of the switching element 112 based on the analog signal so that the drive current $I_{LED}$ approximates to the target value. The digital value may be counted at a speed determined by an ON/OFF cycle of the switching element 122.

What is claimed is:

1. A semiconductor light source lighting circuit comprising:

a switching regulator that generates a drive current of a semiconductor light source using a switching element; and a control circuit that controls ON/OFF of the switching element so that the drive current approximates to a target value, wherein the control circuit comprises:

a comparator that compares the drive current and the target value;

an up/down counter that counts a digital value in a count direction determined by a comparison result of the comparator;

a digital-analog converter that converts the digital value counted by the up/down counter into an analog signal; and a drive circuit that controls the ON/OFF of the switching element based on the analog signal which is obtained as a result of the conversion by the digital-analog converter, and wherein the up/down counter counts said digital value at a speed determined by an ON/OFF cycle of the switching element, wherein the drive circuit controls the ON/OFF of the switching element based on a signal outputted from a first oscillator, wherein the up/down counter performs a counting operation based on a signal outputted from a second oscillator different from the first oscillator when the difference between said drive current and the target value is greater than a current threshold, and wherein, when the difference between the drive current and the target value is greater than the current threshold, the up/down counter counts the digital value faster than a case when the difference between the drive current and the target value is smaller than the current threshold.

2. The semiconductor light source lighting circuit according to claim 1, wherein the up/down counter counts the digital value faster as the ON/OFF cycle of the switching element is shorter.

3. The semiconductor light source lighting circuit according claim 1, further comprising:

a discrimination circuit that discriminates a magnitude relation between the ON/OFF cycle of the switching element 5 and a cycle threshold, and a determination circuit that determines a counting speed of the up/down counter based on the discrimination result of the discrimination circuit.

* * * * *